US008763534B2

(12) United States Patent
Lebacher

(10) Patent No.: US 8,763,534 B2
(45) Date of Patent: Jul. 1, 2014

(54) MOLDED PART, AND METHOD FOR THE PRODUCTION OF THE MOLDED PART

(75) Inventor: Walter Lebacher, Aschau am Inn (DE)

(73) Assignee: Nitrochemie Aschau GmbH, Aschau am Inn (DE)

( * ) Notice: Subject to any disclaimer, the term of this patent is extended or adjusted under 35 U.S.C. 154(b) by 228 days.

(21) Appl. No.: 12/522,068

(22) PCT Filed: Dec. 7, 2007

(86) PCT No.: PCT/EP2007/010676
§ 371 (c)(1),
(2), (4) Date: Jul. 2, 2009

(87) PCT Pub. No.: WO2008/080506
PCT Pub. Date: Jul. 10, 2008

(65) Prior Publication Data
US 2010/0018429 A1 Jan. 28, 2010

(30) Foreign Application Priority Data
Jan. 4, 2007 (DE) ..... 10 2007 001 655

(51) Int. Cl.
*F42B 5/02* (2006.01)
*F42B 5/18* (2006.01)
*F42B 5/188* (2006.01)

(52) U.S. Cl.
USPC ..... 102/430; 102/431; 264/3.1

(58) Field of Classification Search
USPC ..... 102/430, 431, 432, 464; 264/3.1, 3.2, 264/3.3, 3.4
See application file for complete search history.

(56) References Cited

U.S. PATENT DOCUMENTS

| | | | | |
|---|---|---|---|---|
| 3,823,668 A * | 7/1974 | Remaly et al. | ..... | 102/433 |
| 3,901,153 A * | 8/1975 | Brabets et al. | ..... | 102/433 |
| 3,981,246 A * | 9/1976 | Luther et al. | ..... | 102/521 |
| 5,138,949 A | 8/1992 | Swartout et al. | | |

FOREIGN PATENT DOCUMENTS

| | | |
|---|---|---|
| DE | 30 08 996 | 9/1981 |
| DE | 30 08 999 A | 9/1981 |
| DE | 43 18 740 | 12/1994 |
| EP | 0 248 978 | 12/1987 |
| EP | 0 526 835 | 2/1993 |

* cited by examiner

*Primary Examiner* — James Bergin
(74) *Attorney, Agent, or Firm* — Lucas & Mercanti, LLP; Klaus P. Stoffel

(57) ABSTRACT

To increase the function and safety of a weapon, it is proposed that the molded part, as connecting site particularly between a projectile and a preferably combustible sleeve containing a driving mechanism, be constructed in such a way that, in a predefined region, said molded part has a felt with an energetic material and/or an inert material.

9 Claims, 1 Drawing Sheet

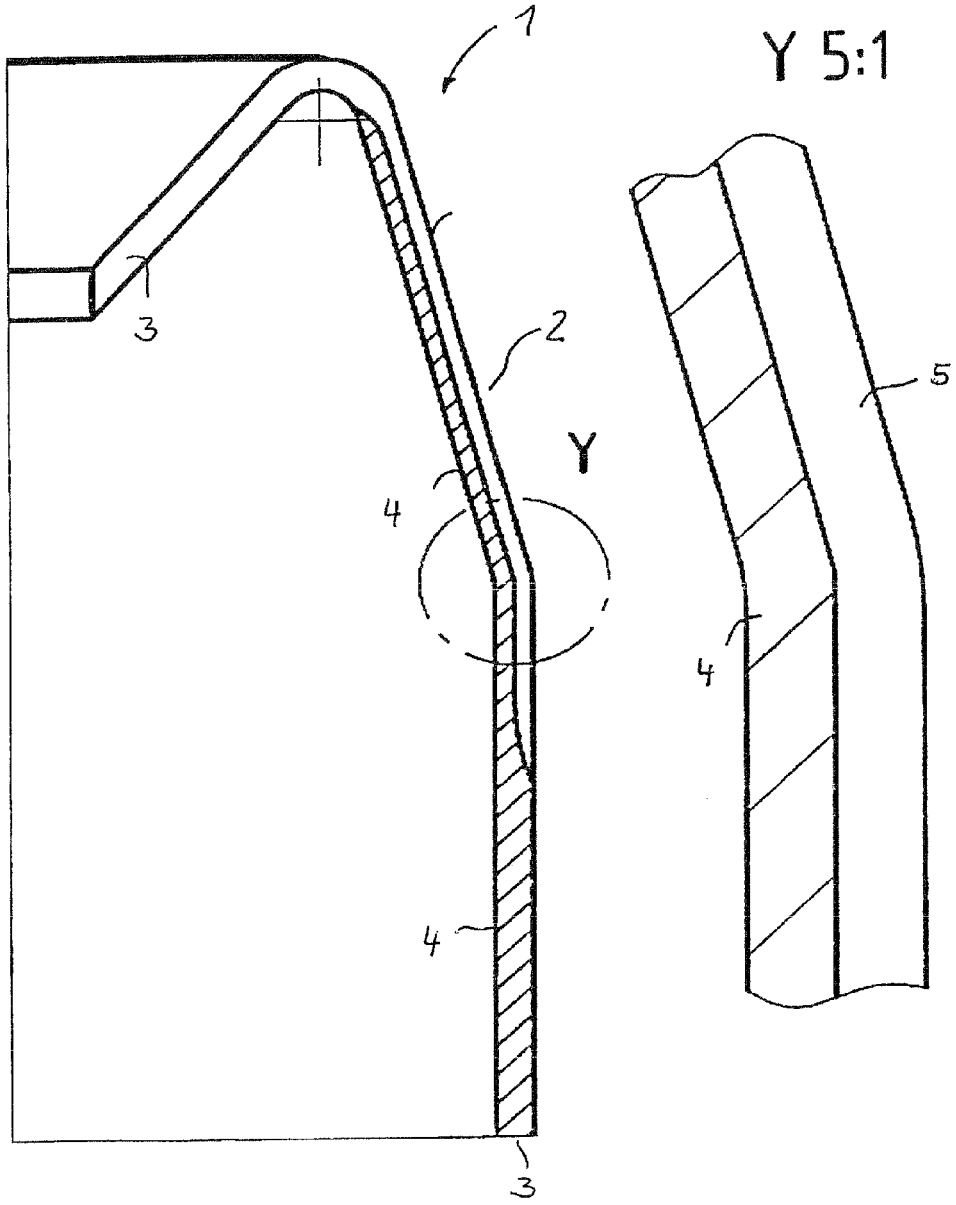
1
Y 5:1
3
2
5
Y
4
4
4
3

MOLDED PART, AND METHOD FOR THE PRODUCTION OF THE MOLDED PART

This application is a 371 of PCT/EP2007/010676 filed Dec. 7, 2007, which in turn claims the priority of DE 10 2007 001 655.9 filed Jan. 4, 2007, the priority of both applications is hereby claimed and both applications are incorporated by reference herein.

BACKGROUND OF THE INVENTION

Certain parts of a cartridge, in particular with a combustible sleeve, are produced from inert material. Such inert materials are provided for instance at connecting points between the driving mechanism and the projectile.

There are two decisive factors for the selection of explosive-free material. The strength of the noncombustible molded part together with the adhesives used on the tail part of the projectile to be attached has proven to be one such factor. Far more important, however, is that the inert material is flame resistant.

Noncombustible inert molded parts must be erosively removed by the mechanical effect of the weapon housings and the hot gases. This means that corresponding connecting parts, which in the case of 120 mm cartridges are known as cartridge covers, must be broken up on firing, and/or so weakened by erosion that only fragments remain. This generally takes place when there is increasing pressure and formation of hot gases in the breech area. The destroyed parts are then flushed out of the breech area and the gun barrel by the gas flow. However, the effect of the combustion gases is not always adequate, so that larger, and in particular thicker, residual pieces are left over in the breech area or may become attached to the cone piece between the breech area and the barrel. The desired removal mechanisms are counteracted, however, by the additional use of polyethanes in the molded parts to provide appropriate strength.

A further problem arises, however, from the fact that, in an ammunition container and in the assembly area of a weapon, the cartridge has at this connecting point direct contact with holding devices or the like. Under the relatively rough handling conditions of heavy cartridges and additional adverse environmental influences, vibration and associated mechanical stresses at these points can become a possible source of risk to the function of the cartridge in the breech area of the weapon. This has the consequence that the function of the weapon and safety are adversely affected, since under some circumstances the next cartridge can no longer be loaded or the smoldering residual particles of the cartridge cover could set off the next cartridge prematurely.

SUMMARY OF THE INVENTION

Here the invention takes up the object of eliminating the aforementioned problems, in order in particular to increase the safety of the weapon in this way.

The invention is based on the idea of reducing the proportion of the inert material to a necessary minimum, in particular in the connecting zone or at the connecting point between the driving mechanism and the projectile. For this purpose, it is envisaged to make these molded parts by using what is known as a layered structure, which can be realized by the felting process.

This means that the mass of the inert material is reduced to the amount necessary for strength, while the geometry of the cartridge itself does not have to be changed.

Inside the cartridge, the effect of the hot gases is distinctly improved and the interior ballistic properties can be adapted to the overall concept. Safety-relevant zones remain completely inert in the region of contact points. The inner surfaces to be eroded are accessible earlier and more easily for the combustion gases that are produced. Remaining residual parts are small and consequently can be flushed out more easily by the gas flow.

For this purpose, precisely defined zones of the molded parts are interspersed with high-energy fibrous material, preferably nitrocellulose. The zones are only built up on the side of the molded part that is facing the propellant powder. All safety-relevant regions, such as contact points with the holder in the ammunition container, supporting areas in the turret bunker, points of attachment of projectile parts, etc., remain completely inert however.

This solution also allows for future developments, that more powerful driving mechanisms will be used in high-power munitions. This is because there is the discernible problem here that additional additives with erosion-reducing properties for helping to preserve the barrel from an interior ballistic viewpoint could hinder the removal of the inert cartridge covers.

A layered structure is used in the defined zones. This makes it possible for the depth of the layers, the surface area and the formulation of the molded parts to be made to suit the propellant powder that is used, to arrive at an overall concept.

The erosion of the surface in the breech area is assisted by the hot gases on the inner side of the molded part on firing. The remaining residual amount of inert material is broken up more easily and more completely. The size and mass of the residual parts is distinctly reduced and can be flushed out of the breech area more easily by the stream of gas.

With respect to loading and attachment of the individual component parts for the driving mechanism and the projectile, new approaches can be taken, new variants can alternatively be used.

This sandwich form is realized in the flooding process by the pulps being variously deposited. It is known that such a plant can be subdivided into flooding chambers. This inert formulation is only added in the chambers where an inert coating is also intended to take place.

BRIEF DESCRIPTION OF THE DRAWINGS

The single FIGURE shows a section and an enlarged view of portion of a molded part.

DETAILED DESCRIPTION OF THE INVENTION

The invention is to be explained in more detail on the basis of an exemplary embodiment with the drawing. The single FIGURE shows a representation of a detail of a molded part 1, which has in a predefined region 2, or a predefined partial zone, a felt 3 with a high-energy material 4 and an inert material 5.

In the felting process, it is in this case envisaged to apply on the predefined region 2 a felt 3 with a high-energy formulation. When the required mass of fibrous material 3 has been applied, the entire suction intake area is released and the final raw felt form is formed. For the second step of the process, an inert formulation is chosen.

A two-head plant with an immersion felter and felt zone control is used, for example, for this purpose. The felt formation takes place by a vacuum and time control. The pulp concentration is made to suit the fiber formulation.

This type of production achieves the effect that what is known as a cartridge cover (molded part 1) can be built up with different inner material, preferably combustible material, and outer material, preferably inert material.

A nitrocellulose-free mixture, for example of cellulose and groundwood pulp, can be used for example as the inert material.

The invention claimed is:

1. A molded part as a connecting point between a projectile and a combustible sleeve containing a driving mechanism, the molded part comprising a felt arranged in a predefined region of the molded part, which region is smaller than the entire molded part, the felt including a high-energy, combustible material and an inert, non-combustible material in a layered structure, wherein the high-energy material comprises an inwardly facing layer of the layered structure and the inert material comprises an outwardly facing layer of the layered structure.

2. The molded part according to claim 1, wherein the molded part is formed from an inner material and a different outer material.

3. The molded part according to claim 2, wherein the inner material is combustible and the outer material is inert.

4. The molded part according to claim 3, wherein the inert material is a nitrocellulose-free material and the combustible material is a nitrocellulose-containing material.

5. The molded part according to claim 4, wherein the nitrocellulose-free material contains cellulose and groundwood pulp.

6. The molded part according to claim 1, wherein the inert material is a nitrocellulose-free material and the high energy material is a nitrocellulose-containing material.

7. The molded part according to claim 6, wherein the nitrocellulose-free material contains cellulose and groundwood pulp.

8. The molded part according to claim 1, wherein the molded part has a structure formed as a layered structure.

9. The molded part according to claim 1, wherein the inert material extends, in a longitudinal direction of the molded part, over only a portion of the high-energy material.

* * * * *